US006260273B1

(12) United States Patent
Brice

(10) Patent No.: US 6,260,273 B1
(45) Date of Patent: Jul. 17, 2001

(54) VENTURI BASED VACUUM VALVE METHOD FOR WATER CONSERVATION

(76) Inventor: John L. Brice, 5210 Champagne Dr., Colorado Springs, CO (US) 80919

( * ) Notice: Subject to any disclaimer, the term of this patent is extended or adjusted under 35 U.S.C. 154(b) by 0 days.

(21) Appl. No.: 09/517,435

(22) Filed: Mar. 2, 2000

Related U.S. Application Data

(62) Division of application No. 08/877,650, filed on Jun. 17, 1997.

(51) Int. Cl.[7] ..... B21D 51/00
(52) U.S. Cl. ..... 29/890.12; 137/888
(58) Field of Search ..... 29/890.12, 890.141, 29/890.142, 890.143, 890.132, 557; 239/311, 428.5, 8, 369, 371; 137/888, 896, 3, 114, 603; 4/DIG. 7, 541.6, 541.5, 541.4, 541.3, 601, 596

(56) References Cited

U.S. PATENT DOCUMENTS

| | | | | |
|---|---|---|---|---|
| 2,510,396 | * | 6/1950 | Goodrie | 239/428.5 |
| 2,724,583 | * | 11/1955 | Targosh et al. | 239/311 |
| 2,891,913 | * | 6/1959 | Welford | 239/311 |
| 3,797,747 | * | 3/1974 | Buzzi et al. | 239/311 |
| 4,432,105 | * | 2/1984 | Pitroda | 239/303 |
| 4,573,639 | * | 3/1986 | Logue | 239/428.5 |
| 4,657,185 | * | 4/1987 | Rundzaitis | 239/438 |
| 4,881,575 | * | 11/1989 | Smith | 137/889 |
| 5,356,076 | * | 10/1994 | Bishop | 239/311 |
| 5,823,441 | * | 10/1998 | Nicholson | 239/317 |

* cited by examiner

*Primary Examiner*—I Cuda Rosenbaum
*Assistant Examiner*—Trinh Nguyen
(74) *Attorney, Agent, or Firm*—J. Nevin Shaffer, Jr.; Shaffer & Culbertson, LLP

(57) ABSTRACT

A method of providing venturi based vacuum valve (10) includes the step of providing a plug (12) formed with first (14), second (16) and third (18) openings. The first opening (14) formed in the plug (12) acts as an inlet and is smaller than the second opening (16). The first (14) and second (16) openings are connected within the plug (12) so that a small diameter space (20) is connected with a large diameter space (22) within the plug (12). A third opening (18), open to the atmosphere and forming a suction hole, intersects the small (20) and large (22) diameter space after the small diameter space (20) and before the second opening (16). The second opening (16) forms an outlet in the plug (12). The plug (12) in a preferred embodiment, is form fitted within a shower pipe (26) so that water is received first at the first opening (14). Thereafter, small diameter space (20) opens into large diameter space (22) and air through third opening (18) is mixed therein. The air/water mixture exits second opening (16) and proceeds at high velocity and force through a user's normal unrestricted showerhead attached to the shower pipe (26) thereafter. Preferred embodiments of the invention include adding threads (32 and 34) for engaging the shower pipe (26) and the showerhead.

8 Claims, 1 Drawing Sheet

VENTURI BASED VACUUM VALVE METHOD FOR WATER CONSERVATION

CROSS-REFERENCE TO PRIOR APPLICATION

Because of a restriction requirement, this application is a divisional of U.S. application Ser. No. 08/877,650, filed Jun. 17, 1997, entitled "VENTURI BASED VACUUM VALVE APPARATUS FOR WATER CONSERVATION" by the same inventor. A Notice of Allowance was mailed Dec. 16, 1999. The classification given this divisional application is Class 29, Subclass 890.124.

BACKGROUND OF THE INVENTION

This invention relates to an improved venturi based vacuum valve for modifying the flow rate of liquids. More particularly, this invention relates to a venturi based vacuum valve for improving flow pressure at a lower flow rate.

No one debates the need for water conservation. Low flow water devices have been introduced to conserve both toilet and shower water use. Some low flow shower devices are as simple as placing flow restrictors anywhere along the main water stream so as to interrupt the flow of the water. A problem with these low flow shower water devices in the prior art, however, is that while water flow rate is reduced, the water flow is also reduced so that the feel of a shower at high flow rates is lost altogether. Recently, prior art devices have been developed that introduce air into the water stream at the shower nozzle. This inventor is aware of a product marketed by the DuPont Company under the trademark SPA2001. This device is a shower nozzle with a variety of moving parts that is designed to suck air in at the outlet end of the shower nozzle and introduce it upstream of the outlet.

Drawbacks to the devices known in the art, and this particular DuPont device, are that they require the elimination of the pre-existing shower head with which the user has become accustomed, they include a variety of moveable parts and attachments, and they introduce air from the outlet thereby increasing chances of clogging and fouling with water expelled from the outlet end of the device. Thus, there is a need in the art for providing an improved venturi based vacuum valve that includes no moving parts, that enables the use of existing shower heads, and which provides a venturi effect away from the outlet end of the shower head. It, therefore, is an object of this invention to provide an improved venturi based vacuum valve which includes no moving parts, which is compatible for use with existing shower heads, and which has a venturi effect opening at a location removed from the outlet of the valve.

SHORT STATEMENT OF THE INVENTION

Accordingly, the venturi based vacuum valve of the present invention includes a plug with first, second and third openings. The first opening is formed in the plug as an inlet and is smaller than the second opening. The second opening and the first opening are connected within the plug so that a small diameter space is connected with a large diameter space within the plug. A third opening, open to the atmosphere and forming a suction hole, intersects the small and large diameter space within the plug after the small diameter space and before the second opening. The second opening forms an outlet in the plug. In a preferred embodiment, the plug is conformed to fit entirely within a shower pipe. In another preferred embodiment, the plug includes threads for attachment to a shower pipe and attachment of a shower head to the plug.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
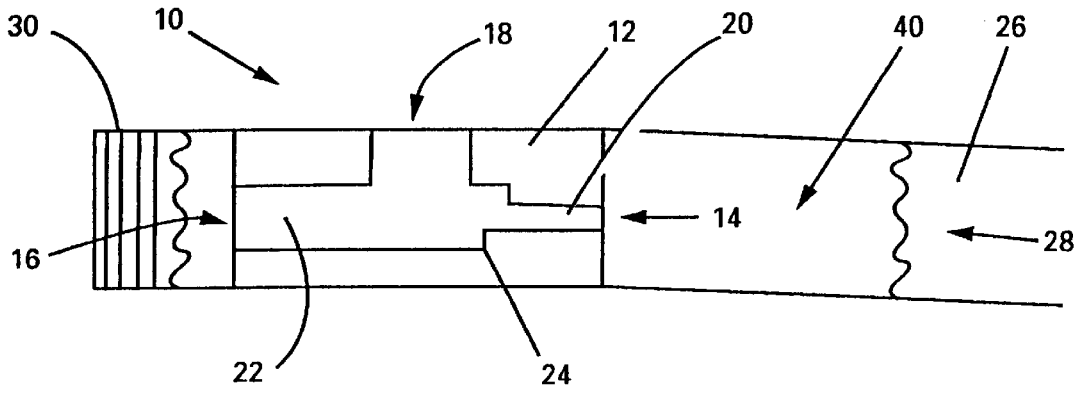
FIG. 1 is a side partial sectional view of a preferred embodiment of the venturi based vacuum valve of the present invention.
Figure 2:
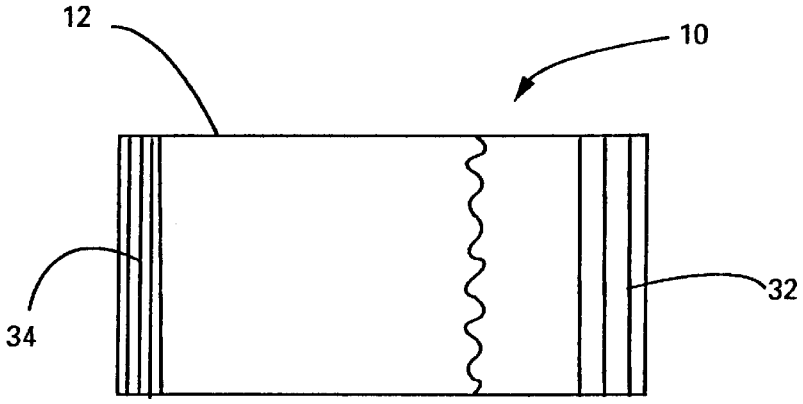
FIG. 2 is a side partial cut away view of a preferred embodiment of the venturi based vacuum valve of the present invention with attachment threads on each end.

The preferred embodiment of the present invention is illustrated by way of example in FIGS. 1–2. With specific reference to FIG. 1, a venturi based vacuum valve 10 includes a plug 12 with a first opening 14, a second opening 16, and a third opening 18. First opening 14 is smaller than second opening 16 and first opening 14 forms a small diameter space 20 which connects with large diameter space 22 of constant dimension (as shown in FIG. 1) formed by larger second opening 16 within plug 12. Small diameter space 20 and large diameter space 22 of constant dimension connect within plug 12 at point 24 as shown in FIG. 1. Third opening 18 is the largest diameter of the three openings and intersects large diameter space 22 after intersection point 24 of large diameter space 22 with small diameter space 20. Third opening 18 is open to the atmosphere and forms an air suction hole.

As shown in FIG. 1, plug 12, in a preferred embodiment, is force fit into shower pipe 26 within which water flows in the direction of arrow 28. FIG. 1 shows shower pipe 26 with showerhead engagement threads 30 to which a typical showerhead (not shown) is attached, as is known in the art.

Referring now to FIG. 2, partial cut away view of plug 12 illustrates another embodiment of the invention wherein internal securing threads 32 and external securing threads 34 are illustrated. In this embodiment, plug 12 is designed to be attached to showerhead engagement threads 30 by means of internal securing threads 32. External securing threads 34 are then available for use in securing a typical showerhead (not shown) as is known in the art.

In operation, venturi based vacuum valve 10 is positioned on the inside 40 of shower pipe 26 so that first opening 14 faces the direction of water flow within shower pipe 26 coming from the direction of arrow 28 as shown in FIG. 1. As a result, first opening 14 forms an inlet in plug 12. First opening 14 as described above, is smaller than second opening 16 and forms a small diameter space 20 into which water flows from the direction of water flow direction arrow 28. At intersection point 24, small diameter space 20 opens into, and connects with, large diameter space 22 of constant dimension. Shortly thereafter, third opening 18 intersects with large diameter space 22 from a single direction, transverse to the connected small and large diameter spaces 20 and 22. As can be seen by FIG. 1, in a preferred embodiment, small and large diameter spaces 20 and 22 of constant dimension are formed essentially longitudinal to the cylindrically shaped plug 12. Third opening 18 is connected transversely to small and large diameter spaces 20 and 22. By means of third opening 18, then, which is open to the atmosphere, air is mixed with incoming water so as to produce a hard, rushing stream of water at a considerably reduced flow rate of water in gallons per minute. Air and water is mixed after intersection point 24 and exits plug 12 from second opening 16 in plug 12 which forms an outlet in plug 12. Thereafter, the water mixed with air is allowed to proceed through the user's normal, accustomed showerhead. By means of the venturi based vacuum valve 10 of the present invention, water flow rates may be reduced to as low as 0.5 to 1.5 gallons per minute while delivering water that feels as though it were flowing at a much higher, and more wasteful, flow rate.

In a preferred embodiment, plug 12 is simply force fit within shower pipe 26 and third opening 18 is aligned with an opening formed in shower pipe 26 so as to provide access of atmospheric air to the device as described above. Alternatively, the plug 12 may be inserted within shower pipe 26 prior to a hole being drilled in shower pipe 26 connecting the atmosphere to plug 12 through third opening 18.

Alternatively, as illustrated in FIG. 2, venturi based vacuum valve 10 may include internal securing threads 32 on the inlet end of plug 12 surrounding first opening 14. When present, internal securing threads 32 enable venturi based vacuum valve 10 to be threaded onto the showerhead engagement threads 30 of shower pipe 26. Thereafter, external securing threads 34 enable the user's normal showerhead to be attached to plug 12. The operation of the venturi based vacuum valve 10 then proceeds as previously described.

While the venturi based vacuum valve 10 of the present invention has been disclosed in connection with use with showers, it should be appreciated that the invention can be used in other flow situations. The present invention provides an improved venturi based vacuum valve which includes no moving parts, can be easily manipulated in order, for example, to be inserted within gas lines, water treatment systems, air-conditioning/chill water systems and the like. Because there are no moving parts, the device is suitable for use with flammable, explosive materials as well as water.

While the present invention has been disclosed in connection with the preferred embodiment thereof, it should be understood that there may be other embodiments which fall within the spirit and scope of the invention as defined by the following claims.

I claim:

1. A method of providing a venturi based vacuum valve comprising the steps of:

(a) forming a cylindrical plug having a longitudinal axis therein;

(b) forming a first small constant diameter opening along the longitudinal axis of the cylindrical plug;

(c) forming a second large constant diameter opening along the longitudinal axis of the cylindrical plug wherein the first opening intersects with the second opening within said cylindrical plug;

(d) forming a third opening in said cylindrical plug transverse to said first opening and before said second opening so as to connect said first and second openings to the atmosphere; and (e) fitting said cylindrical plug to a pipe so that said first opening forms an inlet to receive water from said pipe and said second opening forms an outlet and aligning said third opening with an opening in said pipe so that air is introduced to said cylindrical plug.

2. The method of claim 1 wherein the step of connecting the first and second openings to the atmosphere further comprises the step of connecting said third opening to the large constant diameter of said second opening.

3. The method of claim 1 wherein the step of fitting said cylindrical plug to a pipe includes force-fitting said cylindrical plug within said pipe.

4. The method of claim 1 wherein the step of fitting said cylindrical plug to said pipe further comprises the steps of:

(a) forming threaded attachments on said cylindrical plug and screwing said first opening end of said cylindrical plug onto said pipe; and (b) screwing a delivery head to said second opening end of said cylindrical plug.

5. A method of water conservation in a shower system with water delivered through a shower pipe by slowing the flow rate of the water delivered and increasing the perceived flow rate at the same time, comprising the steps of:

(a) forming a cylindrical plug having a longitudinal axis therein;

(b) forming a first small constant diameter opening along the longitudinal axis of said cylindrical plug;

(c) forming a second large constant diameter opening along the longitudinal axis of said cylindrical plug wherein said first opening intersects with said second opening within said cylindrical plug;

(d) forming a third opening in said cylindrical plug transverse to said first and second openings after the first opening and before the second opening so as to connect said first and second openings to the atmosphere; and (e) fitting said cylindrical plug to a shower pipe so that said first opening forms an inlet to receive water from said shower pipe and said second opening forms an outlet and aligning said third opening with an opening in said shower pipe so that air is introduced to said cylindrical plug.

6. The method of claim 5 wherein the step of connecting the first and second openings to the atmosphere further comprises the step of connecting said third opening to the large constant diameter of said second opening.

7. The method of claim 5 wherein the step of fitting said cylindrical plug to a shower pipe includes forced fitting said cylindrical plug within said shower pipe.

8. The method of claim 5 wherein the step of fitting said cylindrical plug to said shower pipe further comprises the steps of:

(a) forming a threaded attachment on said cylindrical plug and screwing said first opening end of said cylindrical plug onto said shower pipe; and (b) screwing a delivery shower head to said second opening end of said cylindrical plug.

* * * * *